US011401683B2

(12) United States Patent
Portus

(10) Patent No.: US 11,401,683 B2
(45) Date of Patent: Aug. 2, 2022

(54) BUCKET ACTUATOR ASSEMBLY WITH RESILIENT BUMP STOP

(71) Applicant: Caterpillar Inc., Peoria, IL (US)

(72) Inventor: Neil Portus, Hinckley (GB)

(73) Assignee: Caterpillar Inc., Peoria, IL (US)

( * ) Notice: Subject to any disclaimer, the term of this patent is extended or adjusted under 35 U.S.C. 154(b) by 58 days.

(21) Appl. No.: 17/109,428

(22) Filed: Dec. 2, 2020

(65) Prior Publication Data

US 2021/0164191 A1 Jun. 3, 2021

(30) Foreign Application Priority Data

Dec. 2, 2019 (GB) ..... 1917547

(51) Int. Cl.
*E02F 3/40* (2006.01)
*E02F 3/34* (2006.01)

(52) U.S. Cl.
CPC ..... *E02F 3/401* (2013.01); *E02F 3/3417* (2013.01)

(58) Field of Classification Search
CPC ..... E02F 3/3417; E02F 3/401
See application file for complete search history.

(56) References Cited

U.S. PATENT DOCUMENTS 6,951,067 B1 * 10/2005 Dietz ..... E02F 3/431 701/50
6,951,867 B2 10/2005 Dietz et al.
9,809,948 B2 11/2017 Imaizumi et al.
2016/0265185 A1 * 9/2016 Imaizumi ..... E02F 9/2029

FOREIGN PATENT DOCUMENTS

| | | | |
|---|---|---|---|
| CN | 104455153 | A | 3/2015 |
| CN | 108824513 | A | 11/2016 |
| EP | 0170654 | A1 | 2/1986 |
| JP | S5760950 | U | 4/1982 |
| JP | 2013113035 | A | 6/2013 |
| JP | 2019027158 | A | 2/2019 |
| KR | 20150009143 | A | 1/2015 |

OTHER PUBLICATIONS

Great Britain Search Report related to GB Application No. GB1917547.0; reported on Sep. 21, 2020.

* cited by examiner

*Primary Examiner* — Saul Rodriguez
*Assistant Examiner* — Brendan P Tighe

(57) ABSTRACT

A work tool includes a bucket and a hydraulic actuator that pivots the bucket on a frame. The loaded bucket applies a maximum compressive force Fc against a resilient bump stop, which reacts a proportion of the applied force as a restoring force Fr against the actuator. A major proportion of the applied maximum compressive force Fc is reacted between the piston and cylinder, while the restoring force Fr is arranged to be greater than the force Fe applied by the self weight of the empty bucket, such that (Fc>2·Fr), and (Fr>Fe).

11 Claims, 4 Drawing Sheets

FIG. 4
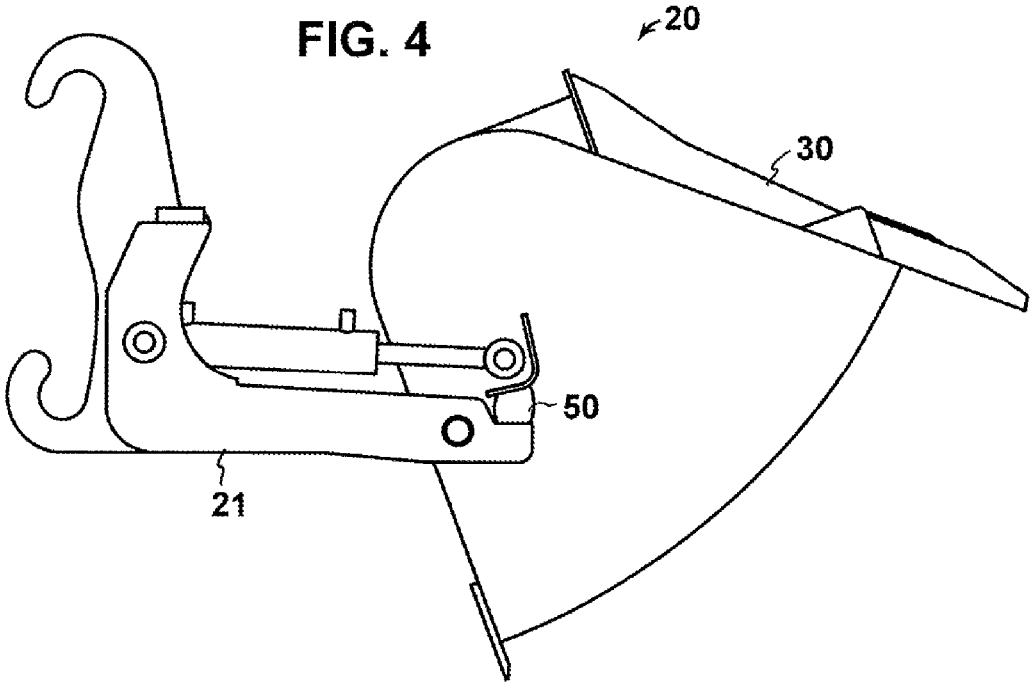
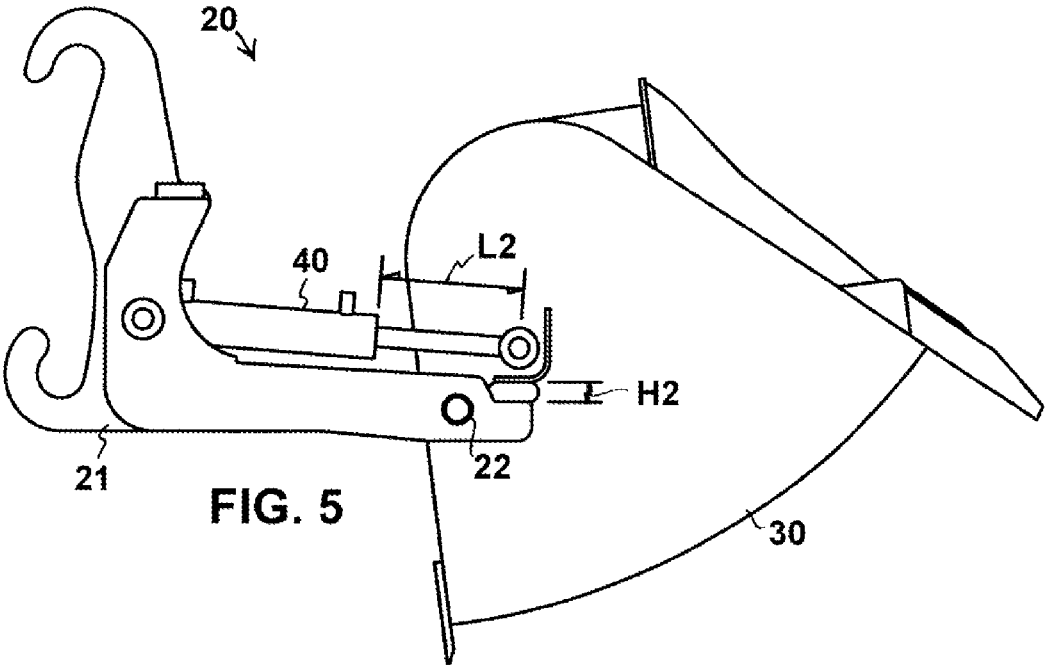
FIG. 5

BUCKET ACTUATOR ASSEMBLY WITH RESILIENT BUMP STOP

CROSS-REFERENCE TO RELATED APPLICATION

This application claims priority under 35 USC § 119 and the Paris Convention to Great Britain Patent Application No. 1917547.0 filed on Dec. 2, 2019.

TECHNICAL FIELD

This disclosure relates to arrangements for damping impact loads arising from the motion of a bucket on a work machine.

BACKGROUND

A work machine may be a wheeled or tracked vehicle, for example, an excavator, a front loader, a backhoe loader, or the like. In such machines the bucket may be configured to carry a load of many tonnes of loose material such as soil or rock when the bucket is in an upwardly facing position, and typically also to dig or scoop the material into the bucket, usually in a forwardly facing position. Such buckets will also have a substantial self weight, and the total weight of the loaded bucket can apply a large impact load to the limit stop as the bucket reaches the downwardly facing, dump position.

It is known to provide a resilient bump stop to help mitigate the impact load as the bucket is tipped.

KR20150009143A discloses a wheel loader with a shock absorbing member arranged to mitigate the impact of the bucket against the dump stop. The shock absorbing member may be a shock absorbing sheet, or an air damper which deflates on impact, or an elastic member such as a spring, or a hydraulic damper.

On many machines, a shock absorber configured to absorb the whole impact load would be unfeasibly large. For example, the frame of a so-called high lift bucket (which is mounted on the frame together with a dedicated actuator to form a complete work tool) is configured to be easily mounted and dismounted from a quick coupler on the arm of the machine, and so typically does not provide enough room for a large shock absorbing assembly.

Often therefore a limit stop arranged on the frame will be made from steel, so that the limit position of the bucket is defined by metal-on-metal contact.

For example, CN104455153A discloses a buffer assembly including an elastic rubber block for absorbing impact energy as the bucket moves to an upwardly open limit position. The assembly includes a steel limit stop to limit compression of the rubber block.

Since a resilient bump stop may be able to absorb only a minor proportion of the applied load, and the impact of the bucket against a metal bump stop is noisy and ultimately damaging, it is often more practical to restrain the bucket in the dump position by reacting the dynamic load within the cylinder of the hydraulic actuator.

Typically this is achieved by abutment of the piston against the cylinder end cap at the end of its stroke. For this purpose the cylinder is often cushioned, which is to say, it may include a so-called cushioning valve, operable by movement of the piston towards the end of its stroke, to restrict the flow of hydraulic fluid out of the cylinder and so reduce the rotational speed of the bucket to limit the internal impact force.

Nevertheless it is found that, even with a cushioning valve, the impact load generated by the momentum of the loaded bucket can cause damage to the cylinder. In addition, repeated cyclical loading causes wear at the pivot joints of the assembly, resulting in looseness which can cause the empty bucket to rattle noisily while in motion, for example, as the machine moves over a rough surface, away from the dumping location and back to the loading location.

This problem can be particularly bothersome in a high lift bucket, since the frame of the work tool supports the bucket at a higher position than a conventional bucket would be, if attached in the same position as the frame to the arm of the machine. The additional reach magnifies the motion of the machine in use and so the bucket can be noisy in operation if the joints are worn.

In order to provide smoother operation, it is known to monitor the movement of a bucket and to control the bucket actuator to progressively reduce the rotational speed of the bucket as it approaches the dump position, for example, as taught by U.S. Pat. No. 6,951,067B1 and U.S. Pat. No. 9,809,948B2. However, position sensors are easily damaged in a harsh operating environment.

SUMMARY

In a first aspect, the present disclosure provides a work tool including a frame, a bucket pivotably mounted on the frame, a hydraulic actuator, and a resilient bump stop.

The hydraulic actuator comprises a piston which is reciprocable in a cylinder to pivot the bucket relative to the frame, in a use position of the frame, through a range of movement between an upwardly open, load carrying position of the bucket and a downwardly open, dump position of the bucket.

The bucket is arranged to apply a maximum compressive force Fc to the bump stop to engage the bump stop in compression between the bucket and the frame as the bucket moves to the dump position.

The bump stop is arranged, in a maximally compressed condition in the dump position of the bucket, to apply a restoring force Fr in opposition to the hydraulic actuator to urge the bucket away from the dump position. The applied maximum compressive force Fc includes a maximum force component Fe corresponding to a force generated by an empty, self weight of the bucket when static in the dump position.

The hydraulic actuator is configured to define a limit position of the piston in the cylinder, and to react a residual force component (Fc−Fr) between the piston and the cylinder in the limit position of the piston to define the dump position of the bucket, wherein ($Fc>2\cdot Fr$), and ($Fr>Fe$).

Further disclosed is a work vehicle including a vehicle body, and a work tool as described above mounted on the vehicle body.

In a related aspect, the disclosure provides a method of operating a work vehicle, including mounting the work tool on the work vehicle, and loading the bucket.

The method further includes controlling the hydraulic actuator, in the use position of the frame, to pivot the loaded bucket to the downwardly open, dump position and to compress the bump stop to the maximally compressed condition while dumping the load.

The method further includes reacting a force applied by the moving bucket between the piston and the cylinder in the limit position of the piston to define the dump position of the bucket; and continuing to control the hydraulic actuator to maintain the piston in the limit position to react, against the hydraulic actuator, a part of the restoring force Fr applied by the bump stop to the empty bucket.

BRIEF DESCRIPTION OF THE DRAWINGS

Further features and advantages will become apparent from the following illustrative embodiment which will now be described, purely by way of example and without limitation to the scope of the claims, and with reference to the accompanying drawings, in which:

FIGS. 2-5 show the operation of the work tool to pivot the bucket, relative to the frame, from a load carrying position (FIG. 2), through an initial contact position of the bucket and bump stop (FIG. 3), then through an intermediate position with the bump stop partially compressed (FIG. 4), to a dump position with the bump stop maximally compressed (FIG. 5).

Reference numerals or characters which appear in more than one of the figures indicate the same or corresponding elements in each of them.

DETAILED DESCRIPTION

Figures 1, 7:
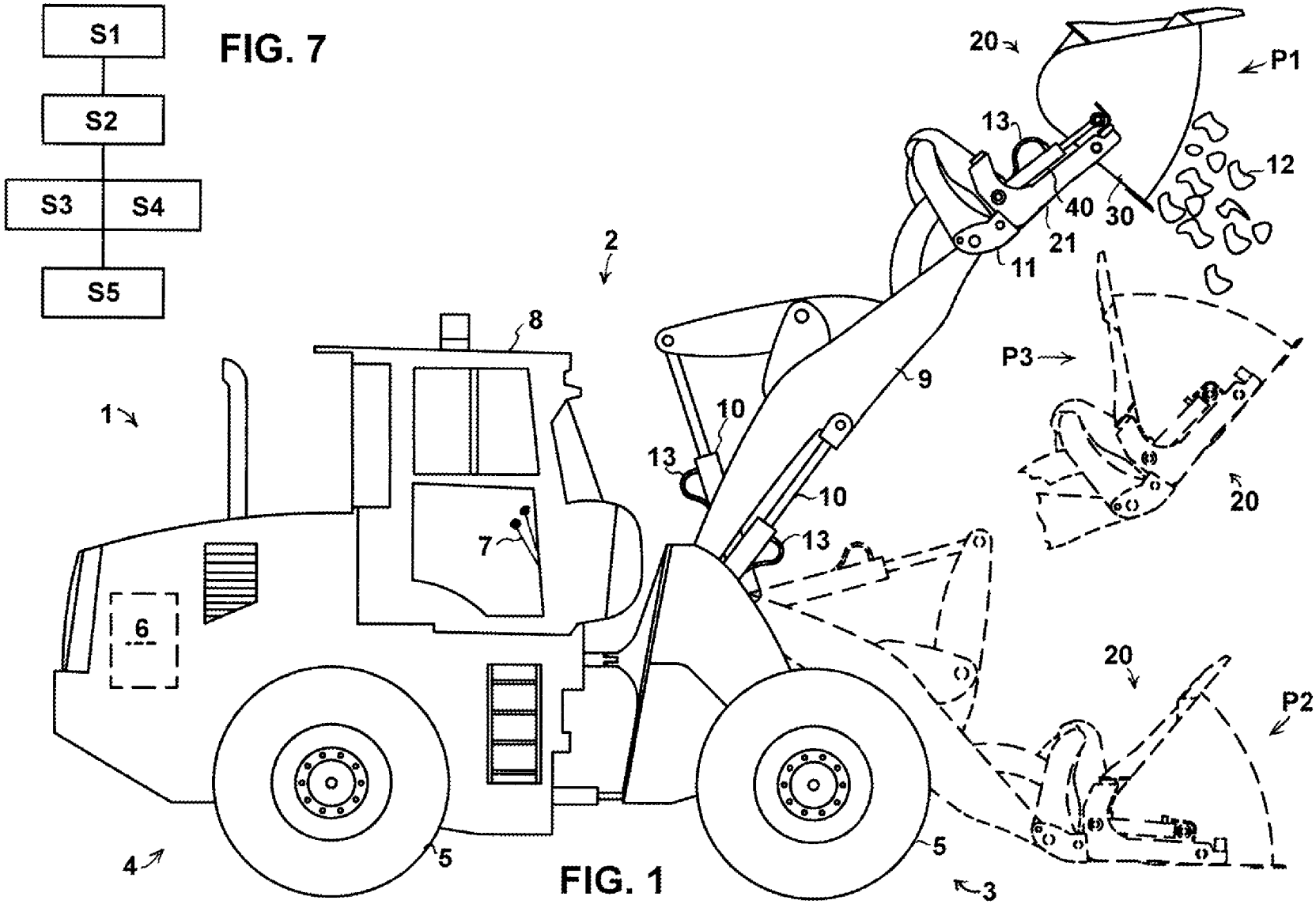
FIG. 1 shows a work tool in accordance with an embodiment, mounted on the body of a work vehicle.
FIG. 7 illustrates steps in accordance with a method of operating the work vehicle.

FIG. 1 shows a work tool 20 in accordance with a first embodiment, mounted on the body 2 of a work vehicle 1. By way of example, the work vehicle illustrated is a front wheel loader, although it could be any other type of work vehicle, which is to say, any other type of vehicle that is configured for mounting a work tool on the vehicle body. It could be a wheeled or tracked vehicle, for example, a backhoe loader or an excavator.

The vehicle body 2 includes a front part 3 and a rear part 4, each including a chassis supported on a pair of wheels 5 driven by an engine which may also supply power to the hydraulic pump and valve assembly 6 that operates the hydraulic functions of the vehicle by fluid pressure via hydraulic hoses 13 responsive to user controls 7 in the cab 8.

The work vehicle 1 further includes an arm 9 pivotably mounted on the body 2, and a hydraulic actuator assembly including actuators 10 which are operable by the user to manipulate the arm 9 by raising and lowering it relative to the body 2. A coupler 11 is arranged at a distal end of the arm 9 to receive a variety of interchangeable work tools such as different buckets, grapples or other handling or digging devices. The coupler 11 may be a so-called quick coupler, which is configured for remote operation by the user when sitting in the cab 8 to couple and decouple a work tool, which reduces the time required to change the work tool.

Referring also to FIGS. 2-6, the work tool 20 includes a frame 21, a bucket 30 which is mounted to rotate about a pivot 22 on the frame 21, and a hydraulic actuator 40. The actuator 40 comprises a piston 41 connected to a piston rod 42 and received in a cylinder 43, within which the piston reciprocates to pivot the bucket about the pivot 22 relative to the frame 21.

In the illustrated example, the work tool is configured as a high tip bucket, also commonly referred to as a high dump bucket, rollout bucket, or front tip bucket. In use, the frame 21 of the work tool is pivotably connected to the vehicle body 2 via the arm 9 and manipulable together with the arm 9 by the actuators 10 forming the hydraulic actuator assembly of the work vehicle. Specifically, the frame 21 is mounted on the coupler 11.

In its configuration as a high tip bucket it will be noted that the work tool, when disconnected from the coupler 11 as shown in FIGS. 2-6, is a self-contained assembly including all its major functional elements, i.e. the frame 21, bucket 30, and actuator 40. The frame 21 includes a mounting portion 23 via which the frame can be releasably connected to the coupler 11 to support the bucket 30 at an elevated position relative to the coupler 11, in a maximally raised position of the coupler and a use position of the frame, shown as P1 in solid lines in FIG. 1.

When mounted on the coupler 11 with the arm 9 and coupler 11 in a lowered position (P2, FIG. 1), the bucket could be configured to be rotated by its actuator 40 to a forwardly facing position as shown to dig a load 12 of loose material from a heap so as to load the bucket, and then to an upwardly open position (P3, FIG. 1) to carry the load while the vehicle 1 moves to a dumping location.

The hydraulic actuators 10 are operable to raise the coupler 11 from the lowered position (P2) to the maximally raised position (P1) as shown in FIG. 1, in which the bucket is elevated relative to the coupler 11. The work tool when configured as a high tip bucket thus provides additional reach for the machine to dump the load 12, for example, into a high-sided vehicle.

In alternative embodiments, the work tool could be configured differently, so that the frame of the work tool is pivotably connected to the vehicle body, not via a quick coupler but as a permanent part of the vehicle, and manipulable by a hydraulic actuator assembly (such as actuators 10) of the work vehicle. In such a configuration the frame could have a form factor similar to the arm 9 if mounted on the illustrated vehicle, so that the bucket would be positioned at a lower height in the maximally raised position of the frame.

For ease of understanding, FIGS. 2-5 show the frame 21 in a constant, horizontal position. However, it will be understood that the frame 21 may be moved relative to the machine body to any desired position, depending on the configuration of the machine, while rotating the bucket about the pivot 22, as shown in FIG. 1.

Figure 2:
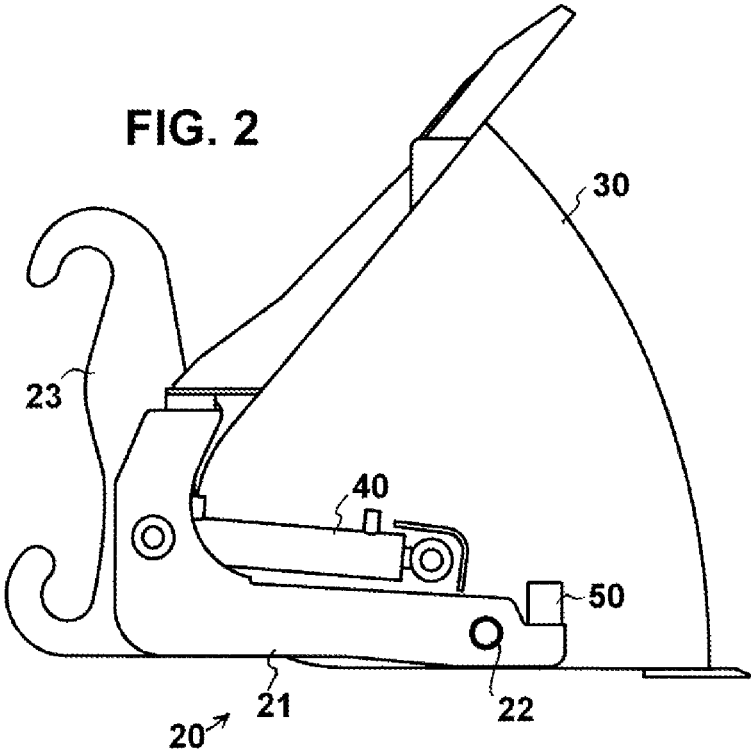

The use position of the frame is taken to be its position (P1, FIG. 1) when the bucket is rotated to the downwardly open, dump position. The use position of the frame (P1, FIG. 1) is very similar to its position as illustrated (P3, FIG. 1) when the bucket is in an upwardly open, load carrying position, which is obtained by fully retracting the piston as shown in FIG. 2.

Thus, it will be understood that in the use position of the frame (P1, FIG. 1), the hydraulic actuator 40 is operable to pivot the bucket 30 relative to the frame 21 through a range of movement between an upwardly open, load carrying position of the bucket (FIG. 2 and P3, FIG. 1) and a downwardly open, dump position of the bucket (FIG. 5 and P1, FIG. 1).

The work tool further includes a resilient bump stop 50, which may include (or consist of) a block of a polyurethane elastomer. The bump stop 50 may be positioned proximate the pivot 22, and the frame 21 may be extended as shown for a short distance beyond the pivot 22 to support the bump stop in this position.

In operation, when the user commands a dump operation, fluid pressure within the cylinder 43 acts on the piston 41 to extend the piston rod 42, which urges the bucket in rotation towards the dump position. As the bucket begins to compress the bump stop (FIG. 3, FIG. 4) it applies a compressive force which may be regarded as the sum of the fluid power of the actuator 40 and the momentum of the moving bucket 30, a part of which momentum is generated by the self weight of the bucket and a part by the weight of the load 12.

A part of the applied compressive force is stored and reacted by resilient compression of the bump stop as a restoring force Fr.

Figure 6:
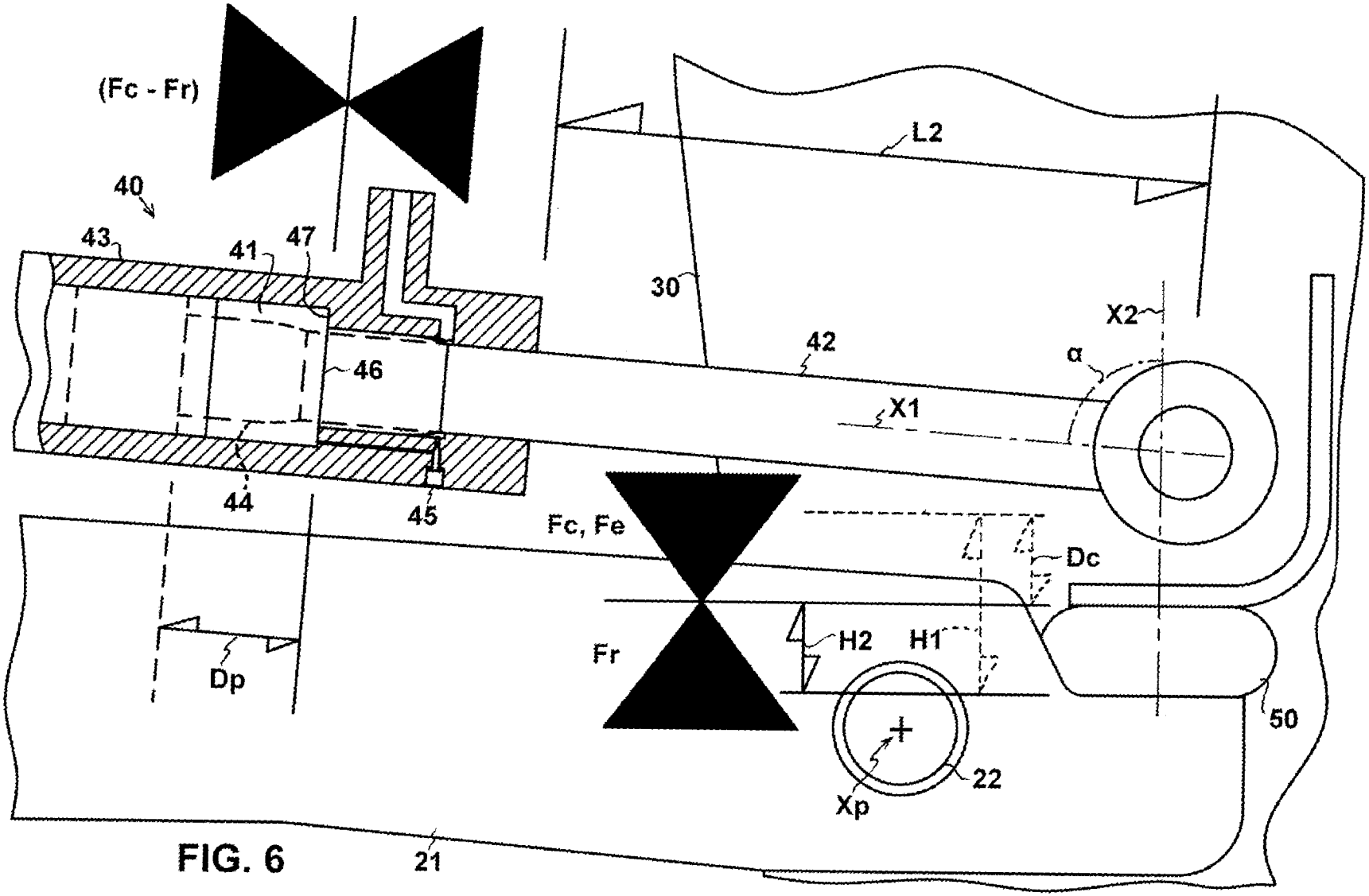
FIG. 6 is an enlarged view of part of the work tool in the dump position of FIG. 5, with the cylinder partially cut away.

As the bucket 30 moves to the dump position at its maximum designed working load under normal use conditions (i.e. normal rotational speed with the vehicle body static on a horizontal ground surface), the bucket applies a maximum compressive force Fc to the bump stop 50 to engage the bump stop 50 in compression between the bucket 30 and the frame 21, as shown in FIGS. 5 and 6 and P1, FIG. 1.

The bump stop is engaged in compression between the bucket and the frame in the sense that it reacts the force applied by the bucket against the frame. This could be achieved in various alternative positions of the bump stop, either by compressing it directly between the bucket and the frame, e.g. as shown, or by applying the force indirectly by interposing another element or elements in-between the bucket and the bump stop and/or in-between the bump stop and the frame.

The applied maximum compressive force Fc includes a maximum force component Fe corresponding to a force generated by the empty, self weight of the bucket when the bucket is static in the dump position (P1, FIG. 1). That is to say, if the empty bucket were static in the dump position and restrained only by the bump stop, then its empty weight acting about the pivot axis Xp of the pivot 22 would apply the maximum force component Fe to the bump stop.

The maximally compressed condition of the bump stop 50 in the dump position of the bucket 30 relative to the frame 21 is best seen in FIGS. 5 and 6. In this condition the bump stop is arranged to apply its restoring force Fr in opposition to the hydraulic actuator 40 to urge the bucket 30 away from the dump position (FIG. 5 and P1, FIG. 1), back towards the upwardly open, load carrying position (FIG. 2 and P3, FIG. 1).

Figure 3:
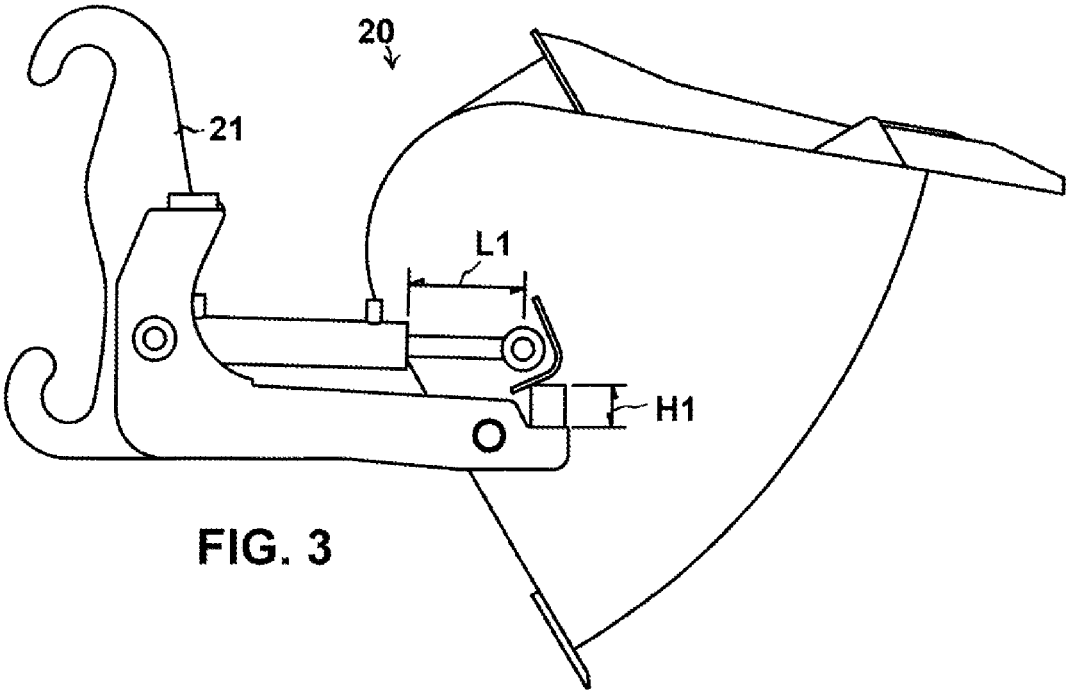

Referring to FIG. 6, the hydraulic actuator 40 is configured to define a limit position of the piston 41 in the cylinder, as shown in solid lines. For comparison, the position of the piston in the initial contact position of the bucket against the dump stop, as shown in FIG. 3, is illustrated in FIG. 6 in broken lines.

The distance of movement of the piston between the limit position and the initial contact position, referred to hereafter as the piston extension distance, is indicated in FIG. 6 as Dp. The piston extension distance Dp corresponds to the difference between the partially extended length L1 of the piston in the initial contact position of FIG. 3, and its fully extended length L2 in the limit position of FIGS. 5 and 6.

In the illustrated example, the actuator 40 has a cushioned cylinder, i.e. it has a cushion valve assembly as known in the art, operable by movement of the piston towards the end of its stroke, to restrict the flow of hydraulic fluid out of the cylinder and so reduce the rotational speed of the bucket to limit the internal impact force.

The cushion valve assembly could include a cylinder spear 44 and needle valve 45 as shown, and acts to restrict the flow of hydraulic fluid leaving the cylinder 43 to reduce the speed of the piston 41 as it nears the end of its stroke. A similar assembly could be provided at the opposite (cap) end of the cylinder as well known in the art.

The hydraulic actuator 40 is configured to react a residual force component (Fc−Fr) between the piston 41 and the cylinder 43 in the limit position of the piston to define the dump position of the bucket. That is to say, the bucket is restrained in its final, dump position by the piston acting against the cylinder, which reacts that portion of the maximum compressive force Fc in excess of the force that is reacted by the bump stop as the restoring force Fr.

The limit position of the piston 41 may be defined by direct abutment between internal surfaces of the hydraulic actuator, e.g. by opposed surfaces 46, 47 respectively of the piston and the end cap of the cylinder, as illustrated. That is to say, the residual force component (Fc−Fr) may be reacted by direct abutment between internal surfaces of the hydraulic actuator.

The shock load applied to the actuator 40 by the momentum of the loaded bucket 30 is reduced by the energy absorbed by compression of the bump stop 50. In addition, as well known in the art, a cushion valve assembly may be provided as shown to further reduce the shock load.

The bump stop 50 is selected to provide a restoring force Fr that is less than half of the maximum compressive force Fc applied by the moving bucket; which is to say, ($Fc>2\cdot Fr$). Thus, more than half of the maximum compressive force Fc is reacted within the actuator 40, between the piston and the cylinder.

However, the restoring force Fr of the bump stop is further selected to be greater than the maximum applied force component Fe corresponding to the self weight of the static bucket in the dump position; which is to say, ($Fr>Fe$).

The bump stop may include (or consist of) a block of solid, resilient material, preferably a polyurethane elastomer, which may be appropriately formulated for use as a bump stop as known in the art. In such arrangements, the capacity of the bump stop to store energy, hence the maximum restoring force Fr, can be determined as well known in the art by appropriately selecting the material, shape and size of the bump stop. For a simple, solid block as illustrated, the relevant dimensions will include its section area normal to the applied force, and its thickness in the direction of the applied force.

Optionally, ($Fe>3\cdot Fr$), and ($Fr>2\cdot Fe$).

Optionally, ($Fe>4\cdot Fr$), and ($Fr>3\cdot Fe$).

In order to obtain a more compact assembly, the work tool may be configured so that the piston extends through a relatively longer distance while compressing the bump stop through a relatively shorter distance. Thus, the bucket may be arranged to compress the bump stop by a compression distance Dc as the piston extends through a piston extension distance Dp, wherein $Dp>Dc$. Optionally, the work tool may be arranged so that $Dp>1.5\ Dc$.

The compression distance Dc corresponds to the difference in height of the bump stop 50 between its uncompressed height H1 as shown in the initial contact position of FIG. 3 and, for comparison, in broken lines in FIG. 6, and its fully compressed height H2 as shown in the dump position of FIGS. 5 and 6.

This can be achieved by mounting the bump stop 50 proximate the pivot 22 and arranging for the bucket 30 to compress the bump stop along a compression axis X2 that is approximately normal to the extension axis X1 of the piston in its limit position—which is to say, the axes X1, X2 intersect to define an angle $\alpha$ in a range from about 70°-90°, preferably about 80°-90°, when considered as projected onto a flat plane (the plane of the drawing) normal to the pivot axis Xp of the bucket, as shown in FIG. 6.

INDUSTRIAL APPLICABILITY

By arranging the bump stop to react against the actuator, as a restoring force Fr, a force in excess of the force Fe applied by the self weight of the empty bucket, the novel arrangement ensures that after tipping the load, and before relieving the fluid pressure in the actuator to return the bucket to the upwardly facing position, the bucket is positively restrained between the compressed bump stop and the actuator by a force Fr that is greater than the force applied by its self weight. This prevents the bucket from rattling in the event that the pivot 22 or other pivot axes in the same assembly have worn. Preferably the restoring force is selected to be at least two times, more preferably at least three times the force applied by the self weight of the empty bucket, to overcome the kinetic energy of the empty bucket so that oscillation and rattling of the empty bucket is prevented even during rapid reversal of the direction of motion at the coupler 11, as would occur for example if the vehicle 1 bounces up and down as it moves rapidly over bumpy ground with the arm 9 fully extended. This advantage may be appreciated particularly in a high lift bucket which is relatively more prone to rattle due to the extended reach of the frame.

At the same time, by limiting to less than half, preferably less than one third, more preferably less than one quarter, the proportion of the maximum compressive force Fc that must be reacted by the bump stop, the novel arrangement provides that the necessary restoring force Fr is within the capacity of a bump stop (particularly if configured as a block of solid resilient material with an energy absorbing capacity greater than natural rubber, such as polyurethane) which is small enough to be arranged between the bucket and the frame without enlarging the overall dimensions of the tool.

Since the hydraulic actuator is typically the most robust component of the assembly, the majority of the applied force is reacted within the actuator, with the bump stop serving to reduce the applied load for example by about one fifth or one quarter, optionally up to about one half. This proportional reduction in shock loading is found to be sufficient to obviate the damage observed in service with prior art assemblies that rely on metal-on-metal bump stops or on rubber bump stops with relatively lower shock absorbing capacity.

By way of example, a bump stop consisting of a solid block of a polyurethane elastomer may be configured to compress through more than 40%, up to about 60%, of its initial height in the direction of the compression axis X2. That is to say, the compression distance Dc may be from about 40%-60% of the initial height H1, for example, about 50% as shown. The block may consist of a polyurethane elastomer with a Shore D hardness of about 65-85, preferably about 75.

The novel arrangement may be applied to a work tool in which the bucket is configured to carry a maximum working load of one tonne, two tonnes, five tonnes, or ten tonnes or more. The maximum compressive force Fc could be for example in excess of ten tonnes, or in excess of fifteen tonnes, of which the principal component may be the force applied by the actuator.

For example, if the bump stop is a block of 75 Shore D hardness polyurethane elastomer and Fc is about sixteen tonnes, of which about 1.5 tonnes is applied by the momentum of the loaded bucket and the remainder by the actuator, then the bucket may weigh about 700 kg and Fr may be about three tonnes.

Referring now to FIG. 7, the work vehicle may be operated as follows to reduce unwanted movement and noise from the bucket. Although the steps are described as carried out by the operator, some or all of them could be automated to define a programmed work cycle performed by the work vehicle 1 responsive to its control system.

At step S1 the work tool is mounted as described above on the work vehicle 1. If the work tool is a high lift bucket then it may be mounted by means of a coupler 11, e.g. a quick coupler. If it is a conventional bucket then it may be mounted as a permanent part of the machine—which is to say, the operator will have to leave the cab to disconnect it, e.g. during routine maintenance.

At step S2 the bucket is loaded with a load 12, e.g. as shown in FIG. 1 (P2).

At step S3 the operator controls the hydraulic actuator 40, in the use position of the frame 21, to pivot the loaded bucket 30 to the downwardly open, dump position (P1, FIG. 1) and to compress the bump stop 50 to the maximally compressed condition while dumping the load 12.

Simultaneously, at step S4, the force applied by the moving bucket 30 is reacted between the piston 41 and the cylinder 43 in the limit position of the piston to define the dump position of the bucket 30, as shown in solid lines in FIG. 6.

At step S5, the operator continues to control the hydraulic actuator 40 to maintain the piston 41 in the limit position to react, against the hydraulic actuator 40, a part of the restoring force Fr applied by the bump stop 50 to the empty bucket 30.

For example, if the restoring force Fr is twice the force applied by the self weight of the empty bucket when static, then in a static condition of the bucket 30 after dumping the load, one half of the restoring force Fr will be reacted by the actuator. As the vehicle moves over bumpy ground, the moving bucket will be retained in fixed relation to the frame 21 until its kinetic energy exceeds the clamping force applied between the bump stop and the actuator. This allows the user to maintain quiet operation until the bucket moves away from the dump position to pick up the next load.

In summary, a work tool 20 includes a bucket 30 and a hydraulic actuator 40 that pivots the bucket 30 on a frame 21. The loaded bucket applies a maximum compressive force Fc against a resilient bump stop 50, which reacts a proportion of the applied force as a restoring force Fr against the actuator 40. A major proportion of the applied maximum compressive force Fc is reacted between the piston 41 and cylinder 43, while the restoring force Fr is arranged to be greater than the force Fe applied by the self weight of the empty bucket 30, such that ($Fc>2 \cdot Fr$), and ($Fr>Fe$).

Many adaptations are possible within the scope of the claims.

In the claims, reference numerals and characters are provided in parentheses, purely for ease of reference, and should not be construed as limiting features. Of course, this does not apply to the formulae.

What is claimed is:

1. A work tool including:

a frame;

a bucket pivotably mounted on the frame;

a hydraulic actuator comprising a piston reciprocable in a cylinder to pivot the bucket relative to the frame, in a use position of the frame, through a range of movement between an upwardly open, load carrying position of the bucket and a downwardly open, dump position of the bucket; and a resilient bump stop;

the bucket being arranged to apply a maximum compressive force Fe to the bump stop to engage the bump stop in compression between the bucket and the frame as the bucket moves to the dump position;

the bump stop being arranged, in a maximally compressed condition in the dump position of the bucket, to apply a restoring force Fr in opposition to the hydraulic actuator to urge the bucket away from the dump position;

the applied maximum compressive force Fc including a maximum force component Fe corresponding to a force generated by an empty, self weight of the bucket when static in the dump position;

the hydraulic actuator being configured to define a limit position of the piston in the cylinder;

wherein the hydraulic actuator is configured to react a residual force component (Fc−Fr) between the piston and the cylinder in the limit position of the piston to define the dump position of the bucket; and (Fc>·Fr), and (Fr>Fe).

2. A work tool according to claim 1, wherein (Fc>3·Fr), and (Fr>2·Fe).

3. A work tool according to claim 1, wherein (Fc>4·Fr), and (Fr>3·Fe).

4. A work tool according to claim 1, wherein the bump stop includes a block of a polyurethane elastomer.

5. A work tool according to claim 1, wherein the bucket is arranged to compress the bump stop by a compression distance Dc as the piston extends through a piston extension distance lip, and Dp>Dc.

6. A work tool according to claim 5, wherein Dp>1.5 Dc.

7. A work tool according to claim 1, wherein residual force component (Fc−Fr) is reacted by direct abutment between internal surfaces of the hydraulic actuator.

8. A work vehicle including:

a vehicle body, and a work tool according to claim 1, the work tool being mounted on the vehicle body.

9. A work vehicle according to claim 8, wherein the frame is pivotably connected to the vehicle body and manipulable by a hydraulic actuator assembly of the work vehicle.

10. A work vehicle according to claim 8, including:

an arm pivotably mounted on the body, a coupler arranged at a distal end of the arm, and a hydraulic actuator assembly operable to manipulate the arm to raise the coupler to a maximally raised position;

wherein the frame is releasably connected to the coupler to support the bucket at an elevated position, relative to the coupler, in the maximally raised position of the coupler and the use position of the frame.

11. A method of operating a work vehicle, including:

mounting on the work vehicle a work tool according to claim 1;

loading the bucket;

controlling the hydraulic actuator, in the use position of the frame, to pivot the loaded bucket to the downwardly open, dump position and to compress the bump stop to the maximally compressed condition while dumping the load;

reacting a force applied by the moving bucket between the piston and the cylinder in the limit position of the piston to define the dump position of the bucket; and continuing to control the hydraulic actuator to maintain the piston in the limit position to react, against the hydraulic actuator, a part of the restoring force Fr applied by the hump stop to the empty bucket.

* * * * *